US005582259A

United States Patent [19]

Barr

[11] Patent Number: 5,582,259

[45] Date of Patent: Dec. 10, 1996

[54] MODULATED BIAS UNIT FOR ROTARY DRILLING

[75] Inventor: John D. Barr, Gloucestershire, Great Britain

[73] Assignee: Camco Drilling Group Limited, Gloucestershire, Great Britain

[21] Appl. No.: 455,777

[22] Filed: May 31, 1995

[30] Foreign Application Priority Data

Jun. 4, 1994 [GB] United Kingdom ..... 9411228

[51] Int. Cl.[6] ..... E21B 7/04

[52] U.S. Cl. ..... 175/73

[58] Field of Search ..... 175/61, 73, 76

[56] References Cited

U.S. PATENT DOCUMENTS 5,293,945 3/1994 Rosenhauch et al. ..... 175/73 X
5,341,886 8/1994 Patton ..... 175/73 X

FOREIGN PATENT DOCUMENTS 2257182 1/1993 United Kingdom .
2259316 3/1993 United Kingdom .

*Primary Examiner*—William P. Neuder

[57] ABSTRACT

A modulated bias unit, for controlling the direction of drilling of a rotary drill bit when drilling boreholes in subsurface formations, comprises a number of hydraulic actuators spaced apart around the periphery of the unit. Each actuator comprises a movable thrust member which is hydraulically displaceable outwardly and a formation-engaging pad which overlies the thrust member and is mounted on the body structure for pivotal movement about a pivot axis located to one side of the thrust member. A selector control valve modulates the fluid pressure supplied to each actuator in synchronism with rotation of the drill bit so that, as the drill bit rotates, each pad is displaced outwardly at the same selected rotational position so as to bias the drill bit laterally and thus control the direction of drilling. The pivot axis of the formation-engaging member is inclined to the longitudinal axis of rotation of the bias unit so as to compensate for tilting of the bias unit in the borehole during operation.

7 Claims, 3 Drawing Sheets

MODULATED BIAS UNIT FOR ROTARY DRILLING

BACKGROUND OF THE INVENTION

When drilling or coring holes in subsurface formations, it is often desirable to be able to vary and control the direction of drilling, for example to direct the borehole towards a desirable target or to control the direction horizontally within the payzone once the target has been reached. It may also be desirable to correct for deviations from the desired direction when drilling a straight hole, or to control the direction of the hole to avoid obstacles.

The two basic means of drilling a borehole are rotary drilling, in which the drill bit is connected to a drill string which is rotatably driven from the surface, and systems where the drill bit is rotated by a downhole motor, either a turbine or a positive displacement motor. Hitherto, fully controllable directional drilling has normally required the use of a downhole motor, and there are a number of well known methods for controlling the drilling direction using such a system.

However, although such downhole motor arrangements allow accurately controlled directional drilling to be achieved, there are reasons why rotary drilling is to be preferred. For example, steered motor drilling requires accurate positioning of the motor in a required rotational orientation, and difficulty may be experienced in this due, for example, to drag and to wind-up in the drill string. Accordingly, some attention has been given to arrangements for achieving a fully steerable rotary drilling system.

For example, British Patent Specification No. 2259316 describes various arrangements in which there is associated with the rotary drill bit a modulated bias unit. The bias unit comprises a number of hydraulic actuators spaced apart around the periphery of the unit, each having a movable thrust member which is hydraulically displaceable outwardly for engagement with the formation of the borehole being drilled. Each actuator has an inlet passage for connection to a source of drilling fluid under pressure and an outlet passage for communication with the annulus. A selector control valve connects the inlet passages in succession to the source of fluid under pressure, as the bias unit rotates. The valve serves to modulate the fluid pressure supplied to each actuator in synchronism with rotation of the drill bit, and in selected phase relation thereto whereby, as the drill bit rotates, each movable thrust member is displaced outwardly at the same selected rotational position so as to bias the drill bit laterally and thus control the direction of drilling.

The present invention provides a development and improvement to the basic type of modulated bias unit to which Specification No. 2259316 relates,

SUMMARY OF THE INVENTION

According to the invention there is provided a modulated bias unit, for controlling the direction of a rotary drill bit when drilling boreholes in subsurface formations, comprising a body structure having an outer peripheral surface;

a formation-engaging member pivotally mounted on the body structure for pivotal movement about a pivot axis outwardly and inwardly with respect to the body structure;

means for applying a thrust to the formation-engaging member to effect said outward movement thereof;

and means for modulating the thrust applied to the formation-engaging member in synchronism with rotation of the body structure, and in selected phase relation thereto whereby, as the bias unit rotates in use, said formation-engaging member is pivoted outwardly at a selected rotational orientation of the bias unit;

said pivot axis of the formation-engaging member being inclined to the longitudinal axis of rotation of the bias unit, Said means for applying a thrust to the formation-engaging member may include a movable thrust member mounted for movement inwardly and outwardly with respect to the body structure, said pivot axis of the formation-engaging member lying to one side of said thrust member, and the formation-engaging member at least partly overlying the thrust member, whereby outward movement of the thrust member causes outward pivoting movement of the formation-engaging member.

In this case the modulated bias unit may further comprise at least one chamber located in the body structure, inlet means for supplying fluid under pressure to said chamber from a source of fluid under pressure, and outlet means for delivering the fluid from said chamber to a lower pressure zone, said movable thrust member being mounted for movement outwardly and inwardly with respect to the body structure in response to fluid pressure in said chamber, said means for modulating the thrust applied to the formation-engaging member comprising means for modulating the pressure of fluid applied to the chamber.

In any of the above arrangements the pivot axis of the formation-engaging member may be inclined at an angle in the range of 2°–45°, or 3°–35°, to the longitudinal axis of rotation of the bias unit.

Preferably the pivot axis of the formation-engaging member intersects the line of intersection between a plane containing the bias unit axis and the centre of the formation-engaging member and a transverse plane which, in use, is disposed substantially at the level of the gauge trimmers on a drill bit coupled to the bias unit. The pivot axis may be inclined substantially at right angles to said line of intersection.

DETAILED DESCRIPTION OF THE PREFERRED EMBODIMENT

Figure 1:
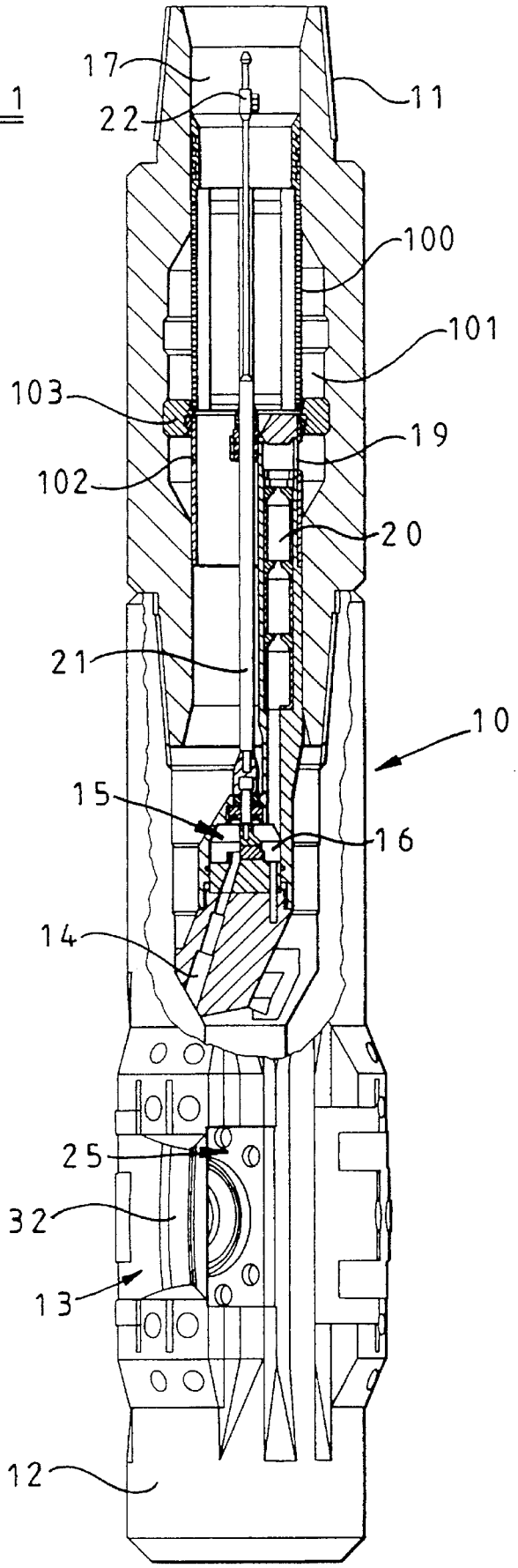
FIG. 1 is a part longitudinal section, part side elevation of a modulated bias unit of a kind which may be modified in accordance with the invention.

Referring to FIG. 1, the bias unit comprises an elongate main body structure 10 provided at its upper end with a tapered externally threaded pin 11 for coupling the unit to a drill collar, incorporating a control unit, for example a roll stabilised instrument package, which is in turn connected to the lower end of the drill string. The lower end 12 of the body structure is formed with a tapered internally threaded socket shaped and dimensioned to receive the standard form of tapered threaded pin on a drill bit. In the aforementioned British Patent Specification No. 2259316 the exemplary arrangements described and illustrated incorporate the modulated bias unit in the drill bit itself. In the arrangement shown in the accompanying drawings the bias unit is separate from the drill bit and may thus be used to effect steering of any form of drill bit which may be coupled to its lower end.

There are provided around the periphery of the bias unit, towards its lower end, three equally spaced hydraulic actuators 13, the operation of which will be described in greater detail below. Each hydraulic actuator 13 is supplied with drilling fluid under pressure through a passage 14 under the control of a rotatable disc valve 15 located in a cavity 16 in the body structure of the bias unit.

Drilling fluid delivered under pressure downwardly through the interior of the drill string, in the normal manner, passes into a central passage 17 in the upper part of the bias unit and flows outwardly through a cylindrical filter screen 100 into a surrounding annular chamber 101 formed in the surrounding wall of the body structure of the bias unit. The filter screen 100, d an imperforate tubular element 102 immediately below it, are supported by an encircling spider 103 within the annular chamber 101. Fluid flowing downwardly past the spider 103 to the lower part of the annular chamber 101 flows through an inlet 19 into the upper end of a vertical multiple choke unit 20 through which the drilling fluid is delivered downwardly at an appropriate pressure to the cavity 16.

The disc valve 15 is controlled by an axial shaft 21 which is connected by a coupling 22 to the output shaft (not shown) of the aforementioned control unit (also not shown) in a drill collar connected between the pin 11 and the lower end of the drill string.

The control unit may be of the kind described and claimed in British Patent Specification No. 2257182.

During steered drilling, the control unit maintains the shaft 21 substantially stationary at a rotational orientation which is selected, either from the surface or by a downhole computer program, according to the direction in which the bottom hole assembly, including the bias unit and the drill bit, is to be steered. As the bias unit 10 rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally away from the position where the actuators are operated. The selected rotational position of the shaft 21 in space thus determines the direction in which the bias unit is laterally displaced and hence the direction in which the drill bit is steered.

The hydraulic actuators will now be described in greater detail with particular reference to FIG. 2.

Figure 2:
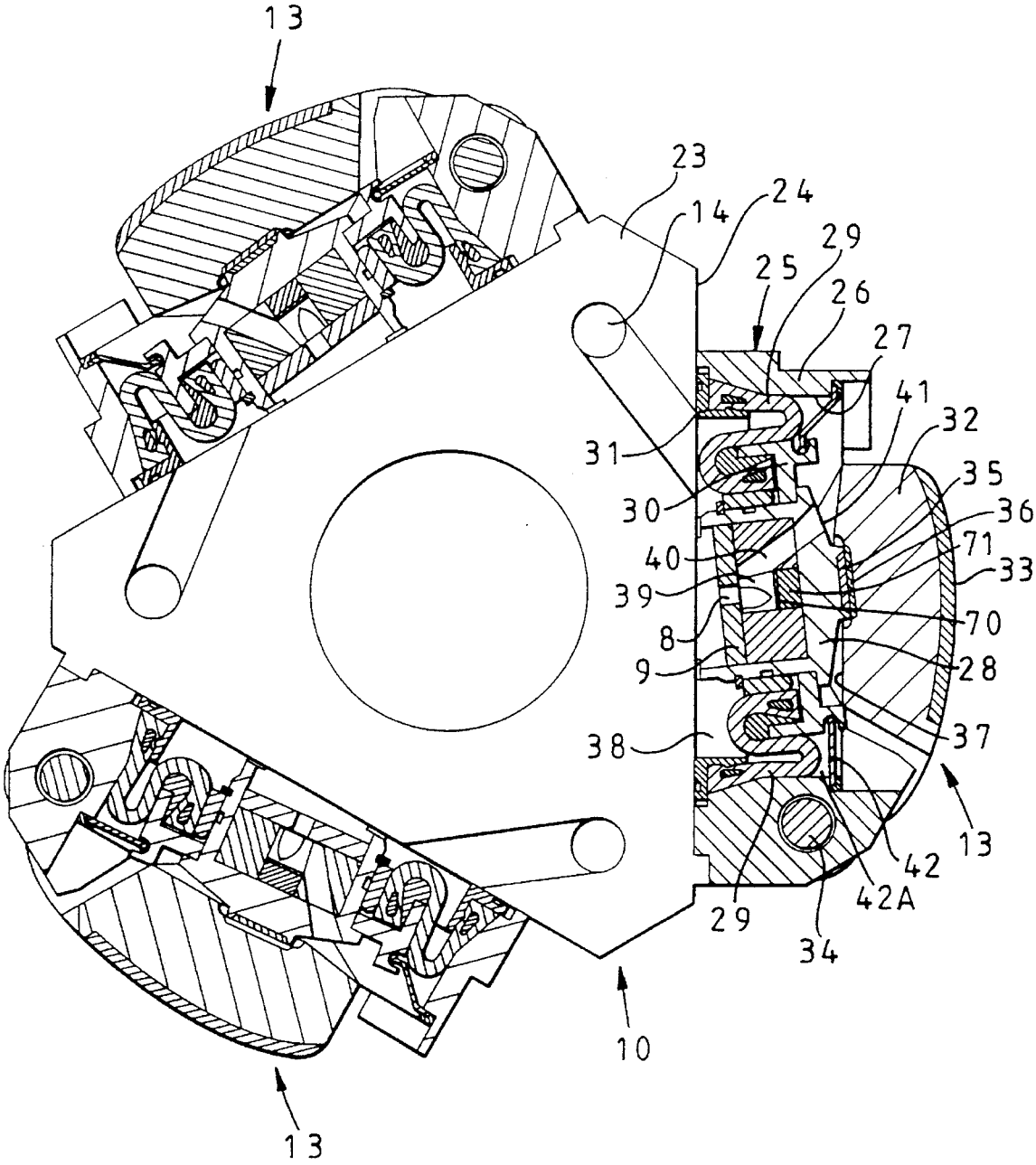
FIG. 2 is a horizontal cross-section through the bias unit, taken along the line 2—2 of FIG. 1.

Referring to FIG. 2: at the location of the hydraulic actuators 13 the body structure 10 of the bias unit comprises a central core 23 of the general form of an equilateral triangle so as to provide three outwardly facing flat surfaces 24.

Mounted on each surface 24 is a rectangular support unit 25 formed with a circular peripheral wall 26 which defines a circular cavity 27. A movable thrust member 28 of generally cylindrical form is located in the cavity 27 and is connected to the peripheral wall 26 by a fabric-reinforced elastomeric annular rolling diaphragm 29. The inner periphery of the diaphragm 29 is clamped to the thrust member 28 by a clamping ring 30 and the outer periphery of the rolling diaphragm 29 is clamped to the peripheral wall 26 by an inner clamping ring 31. The diaphragm 29 has an annular portion of U-shaped cross-section between the outer surface of the clamping ting 30 and the inner surface of the peripheral wall 26.

A pad 32 having a part-cylindrically curved outer surface 33 is pivotally mounted on the support unit 25, to one side of the thrust member 28 and cavity 27, by a pivot pin 34 the longitudinal axis of which is parallel to the longitudinal axis of the bias unit. The outer surface of the cylindrical thrust member 28 is formed with a shallow projection having a flat bearing surface 35 which bears against a flat bearing surface 36 in a shallow recess formed in the inner surface of the pad 32. The bearing surfaces 35 and 36 are hardfaced.

The part of the cavity 27 between the rolling diaphragm 29 and the surface 24 of the central core 23 defines a chamber 38 to which drilling fluid under pressure is supplied through the aforementioned associated passage 14 when the disc valve 15 is in the appropriate position. When the chamber 38 of each hydraulic unit is subjected to fluid under pressure, the thrust member 28 is urged outwardly and by virtue of its engagement with the pad 32 causes the pad 32 to pivot outwardly and bear against the formation of the surrounding borehole and thus displace the bias unit in the opposite direction away from the location, for the time being, of the pad 32. As the bias unit rotates away from the orientation where a particular hydraulic actuator is operated, the next hydraulic actuator to approach that position is operated similarly to maintain the displacement of the bias unit in the same lateral direction. The pressure of the formation on the previously extended pad 32 thus increases, forcing that pad and associated thrust member 28 inwardly again. During this inward movement fluid is expelled from the chamber 38 through a central choke aperture 8 formed in a plate 9 mounted on the thrust member 28, the aperture 8 communicating, with a cavity 39. Three circumferentially spaced diverging continuation passages 40 lead from the cavity 39 to three outlets 41 respectively in the outwardly facing surface or the thrust member 28, the outlets being circumferentially spaced around the, central bearing surface 35.

Drilling fluid flowing out of the outlets 41 washes over the inner surface 37 of the pad 32 and around the inter-engaging bearing surfaces 35 and 36 and thus prevents silting up of this region with debris carried in the drilling fluid which is at all times flowing past the bias unit along the annulus. The effect of such silting up would be to jam up the mechanism and restrict motion of the pad 32.

If the rolling diaphragm 29 were to be exposed to the flow of drilling fluid in the annulus, solid particles in the drilling fluid would be likely to find their way between the diaphragm 29 and the surfaces of the members 26 and 30 between which it rolls, leading to rapid abrasive wear of the diaphragm. In order to prevent debris in the drilling fluid from abrading the rolling diaphragm 29 in this manner, a protective further annular flexible diaphragm 42 is connected between the clamping ring 30 and the peripheral wall 26 outwardly or the rolling diaphragm 29. The flexible diaphragm 42 may be fluid permeable so as to permit the flow of clean drilling fluid into and out of the annular space 42A between the diaphragms 29 and 42, while preventing the ingress of solid particles and debris into that space.

Instead of the diaphragm 42 being fluid permeable, it may be impermeable and in this case the space 42A between the diaphragm 42 and the rolling diaphragm 29 may be filled with a flowable material such as grease. In order to allow for changes in pressure in the space between the diaphragms, a passage (not shown) may extend through the peripheral wall 26 of the support unit 25, so as to place the space between the diaphragms 42, 29 into communication with the annulus between the outer surface of the bias unit and the surrounding borehole. In order to inhibit escape of grease through such passage, or the ingress of drilling fluid from the annulus, the passage is filled with a flow-resisting medium, such as wire wool or similar material.

Each rectangular support unit 25 may be secured to the respective surface 24 of the core unit 23 by a number of screws. Since all the operative components of the hydraulic actuator, including the pad 32, thrust member 28 and rolling diaphragm 29, are all mounted on the unit 25, each hydraulic actuator comprises a unit which may be readily replaced in the event of damage or in the event of a unit of different characteristics being required.

In the modulated bias unit shown in FIGS. 1 and 2, and as described in British Patent Specification No. 2259316 where each hydraulic actuator comprises a pivoted pad, the pivot axis of each pad, and its formation-engaging surface, extends generally parallel to the central longitudinal axis of the bias unit. However, when the bias unit is in operation the longitudinal axis of the bias unit will normally be tilted in relation to the longitudinal axis of the lower part of the borehole in which it is operating. Consequently, in the earlier arrangements as each pad is pivoted towards the formation its outer surface remains inclined at an angle to the surface of the formation as it moves into contact with it. This may lead to rapid wear of the pad in the area of contact and the pad may also tend to remove the formation and enlarge the hole.

The location of the part of each pad which contacts the formation will change as the pad is swept around the walls of the borehole and each pad will therefore tend, with use, to wear in a curve both horizontally and vertically. Such wear will reduce the tendency of the pads to cut into the formation and enlarge the hole, and there may therefore be advantage in initially designing each pad to have both a curvature in vertical planes through the central axis of the bias unit, and a curvature, in horizontal planes, which is of smaller radius than the borehole. However, the resulting small area of contact between each pad and the formation will increase the stresses to which the pad is subjected during operation of the unit.

Figure 3:
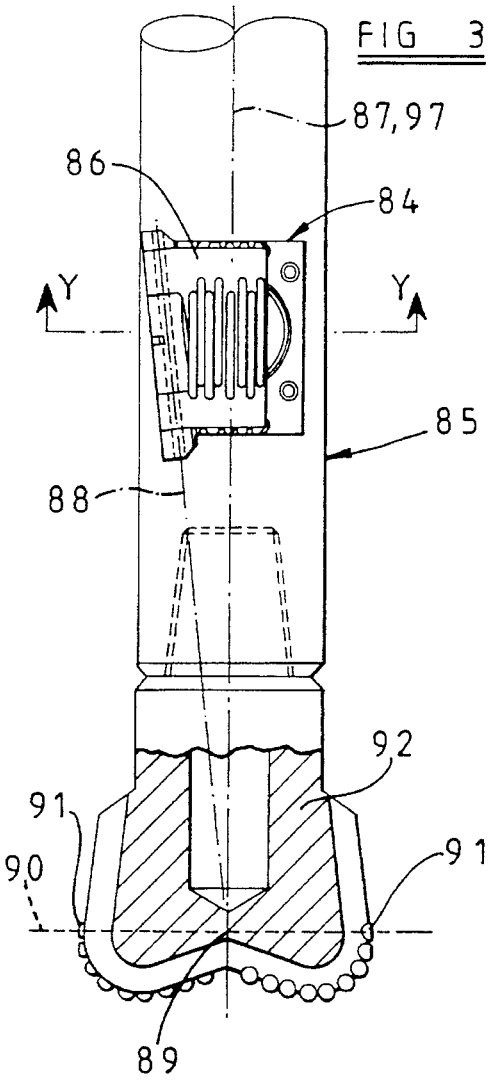
FIG. 3 is a part-sectioned side elevation of a modified form of the modulated bias unit, according to the invention, fired to a drill bit.
Figure 4:
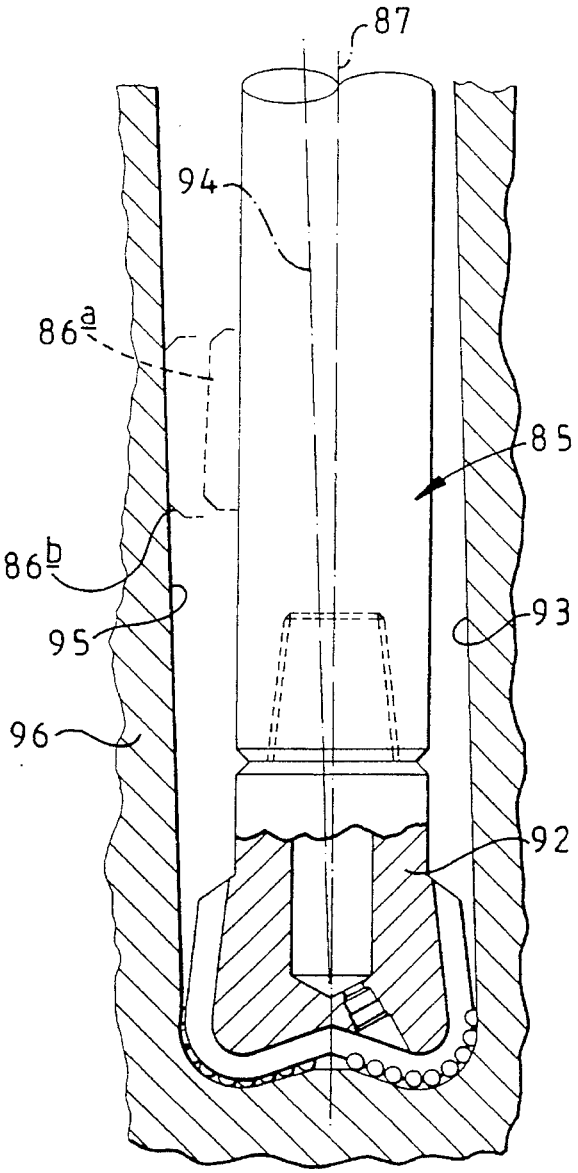
FIG. 4 shows the bias unit and drill bit of FIG. 3 in operation down a borehole.

FIGS. 3 and 4 show a modification of the bias unit of FIGS. 1 and 2, in accordance with the present invention, which sets out to reduce the above-mentioned undesirable effects.

Referring to FIG. 3, each hydraulic actuator 84 of the modulated bias unit 85 comprises a hinged pad 86 pivotally mounted on the body of the bias unit. The detailed construction of each actuator 84 may be of any of the kinds previously referred to, for example it may be of the kind described with reference to FIG. 2 or of any of the kinds described in British Patent Specification No. 2259316 where the actuator comprises a pivoted pad. The construction or operation of the actuator will not therefore be described in further detail.

Figure 5:
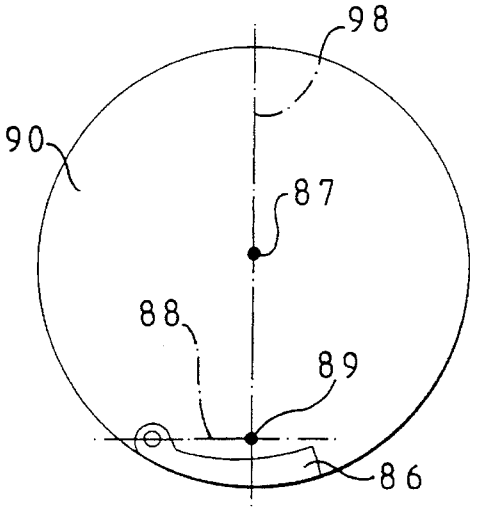
FIG. 5 is a diagrammatic representation of the location and orientation of the actuator pivot axis, as viewed axially downwards of the bias unit.

As best seen in FIG. 3, instead of being pivoted for movement about an axis which is parallel to the longitudinal axis 87 of the bias unit, the pivot axis 88 between the pad 86 and the bias unit is inclined with respect to the longitudinal axis 87 of the bias unit. FIG. 5 is a diagrammatic representation of the location and orientation of the inclined pivot axis 88 as viewed axially of the bias unit. The chain line 98 FIG. 5 is the line of intersection between a radial plane 97 containing the bit axis 87 and passing through the centre of the pad 86 and a transverse plane 90 at the level of the gauge trimmers 91 on the drill bit 92. It will be seen that the axis 88 is inclined to pass through this line of intersection 98 at a point indicated at 89. In the arrangement shown in FIG. 5, the axis 88 of the pivot extends at right angles to the line of intersection 98, but the point of intersection 89 could be located elsewhere along the line of intersection so that the axis 88 is inclined at a different angle thereto.

The result of this inclination of the pivot axis 88 is that upper parts of the pad 86, i.e. parts further from the drill bit 92, move outwardly a greater distance than lower parts, nearer the drill bit, in proportion to their axial distance from the plane 90 of the gauge trimming cutters 91.

FIG. 4 shows the bias unit 85 in a borehole 93, in a situation where the bias unit and drill bit 92 are being biased to the right, It will be seen that as a result of the rightward bias the central longitudinal axis 87 of the bias unit and drill bit is tilted at an angle to the central axis 94 of the lower part of the borehole. Consequently the actuator of the bias unit 85 which is, for the time being, at the left hand side in FIG. 4, is tilted at an equal angle to the surface 95 of the formation 96. There is indicated in broken line at **86*a* the innermost position of the pad 86 of the actuator, where the outer surface of the pad 86 is generally parallel to the longitudinal axis 87 of the bias unit 85. However, as the pad 86 is swung outwardly about the axis 88 by the actuator 84, the upper parts of the pad move a greater distance than the lower parts, due to the angle of inclination of the axis 88. The pad therefore tilts as it is pivoted outwardly so that when the outer surface of the pad 86 engages the surface 95 of the formation its tilting ensures that it makes line contact, or close to line contact, with the formation as indicated in solid lines at 86*b***.

It will be appreciated that exact line contact may not occur under all conditions since there is likely to be some variation in the attitude of the bias unit relative to the walls of the borehole, However, the angular set up shown in FIG. 3 will theoretically give line contact because the distance the pad 86 has to pivot will be dependent on the angle of inclination of the bias unit axis to the borehole axis.

Since the arrangement results in line contact of the pad with the formation, instead of point contact, it will tend to reduce the rate of wear of the pad and the pad will also have less tendency to remove the formation and enlarge the hole. Due to the increased area of contact each pad will also be subject to lower stresses during operation of the bit.

Apart from the modifications specifically described, the bias unit of FIGS. 3 and 4 may incorporate any or all of the other features described in relation to FIGS. 1 and 2.

I claim:

1. A modulated bias unit, for controlling the direction of a rotary drill bit when drilling boreholes in subsurface formations, comprising a body structure having an outer peripheral surface;

a formation-engaging member pivotally mounted on the body structure for pivotal movement about a pivot axis outwardly and inwardly with respect to the body structure;

means for applying a thrust to the formation-engaging member to effect said outward movement thereof;

and means for modulating the thrust applied to the formation-engaging member in synchronism with rotation of the body structure, and in selected phase relation thereto whereby, as the bias unit rotates in use, said formation-engaging member is pivoted outwardly at a selected rotational orientation of the bias unit;

said pivot axis of the formation-engaging member being inclined at an angle greater than 0° to the longitudinal axis of rotation of the bias unit.

2. A modulated bias unit according to claim 1, wherein said means for applying a thrust to the formation-engaging member includes a movable thrust member mounted for movement inwardly and outwardly with respect to the body structure, said pivot axis of the formation-engaging member lying to one side of said thrust member, and the formation-engaging member at least partly overlying the thrust member, whereby outward movement of the thrust member causes outward pivoting movement of the formation-engaging member.

3. A modulated bias unit according to claim 2, further comprising at least one chamber located in the body structure, inlet means for supplying fluid under pressure to said chamber from a source of fluid under pressure, and outlet means for delivering the fluid from said chamber to a lower pressure zone, said movable thrust member being mounted for movement outwardly and inwardly with respect to the body structure in response to fluid pressure in said chamber, said means for modulating the thrust applied to the formation-engaging member comprising means for modulating the pressure of fluid applied to the chamber.

4. A modulated bias unit according to claim 1, wherein the pivot axis of the formation-engage member is inclined at an angle in the range of 2°–45° to the longitudinal axis of rotation of the bias unit.

5. A modulated bias unit according to claim 1, wherein the pivot axis of the formation-engaging member is inclined at an angle in the range of 3°–35°to the longitudinal axis of rotation of the bias unit.

6. A modulated bias unit according to claim 1, wherein the pivot axis of the formation-engaging member intersects the line intersection between a plane containing the bias unit axis and the centre of the formation-engaging member and a transverse plane which, in use, is disposed substantially at the level of the gauge trimmers on a drill bit coupled to the bias unit.

7. A modulated bias unit according to claim 6, wherein the pivot axis of the formation-engaging member is inclined substantially at right angles to said line of intersection.

* * * * *